United States Patent [19]

Creske

[11] Patent Number: 4,570,397

[45] Date of Patent: Feb. 18, 1986

[54] ADJUSTABLE PEDESTAL

[76] Inventor: Edward J. Creske, P.O. Box 1520, Wausau, Wis. 54401

[21] Appl. No.: 582,258

[22] Filed: Feb. 22, 1984

[51] Int. Cl.[4] ..... E04B 5/58

[52] U.S. Cl. ..... 52/126.6; 52/263; 52/726

[58] Field of Search ..... 52/263, 301, 126.4, 52/126.5, 126.6, 726, 724, 725, 727, 728, 296, 20, 743; 285/302, 298

[56] References Cited

U.S. PATENT DOCUMENTS

| | | | |
|---|---|---|---|
| 232,360 | 9/1880 | Milliken | 52/726 |
| 296,181 | 4/1884 | Ketcham | 285/298 |
| 853,750 | 5/1907 | Whorrall | 285/298 |
| 1,018,754 | 2/1912 | Ford | 52/727 |
| 1,302,778 | 5/1919 | Drewry | 285/302 |
| 3,318,057 | 5/1967 | Norsworthy | 52/126.6 |
| 3,390,224 | 6/1968 | Wyatt | 52/20 |
| 3,390,225 | 6/1968 | Couch et al. | 52/20 |
| 3,470,663 | 10/1969 | Tate | 52/126.6 |
| 3,689,017 | 9/1972 | Harvey | 52/301 |
| 3,861,098 | 1/1975 | Schaub | 52/263 |
| 4,038,789 | 8/1977 | Axgarde | 52/20 |
| 4,255,909 | 3/1981 | Soderstrom | 52/20 |

*Primary Examiner*—James L. Ridgill, Jr.
*Attorney, Agent, or Firm*—John S. Roberts, Jr.

[57] ABSTRACT

A collapsible, telescoping pedestal support adapted to be extended and angularly disposed to position the topmost section thereof in a flat level plane which is comprised of a plurality of annular members nested one within the other and each including an upwardly extending tapered wall having camming means adapted to engage the next adjacent wall and lock one to the other. A plurality of pedestal supports can be utilized to provide a flat even surface to support a plurality of tiles to form a deck, floor, patio or the like.

5 Claims, 6 Drawing Figures

ADJUSTABLE PEDESTAL

FIELD OF THE INVENTION

The present invention relates to the erecting of an auxiliary floor, platform or the like, above an existing floor or any uneven surface notwithstanding vertical variations in the same.

BACKGROUND OF THE INVENTION

The prior patented art is aware of collapsible telescoping members utilized in the building area and U.S. Pat. Nos. 3,390,224, 4,038,789 and 4,255,909 are typical representations of the same. Each of these patents disclose telescoping tubular annular ring members used especially in the fabrication of manholes with the adjustable features being utilized to compensate for height variations during installation. U.S. Pat. No. 3,470,663 discloses an adjustable support member having a support base and a frame engaging member at the top thereof whereby a plurality of the same can be utilized to erect an auxiliary floor or platform above a selected surface. The present invention incorporates the ideas of these patents along with other improvements in it's use for erecting an auxiliary elevated floor.

SUMMARY OF THE INVENTION

The present invention is concerned with erecting a usable floor surface, patio, concourse, terrace or the like over an existing floor or any uneven surface in a simple efficient manner. Simply, the invention discloses a collapsible, telescoping support comprised of a plurality of nesting annular ring-like members having means associated with each for locking one to the other in any desired elevated, angular orientation whereby when a plurality of the same are used the topmost portion of each of the supports will be disposed in a common plane to support a floor thereon.

To facilitate the building of the floor, a ring-like member having a plurality of diametrically opposed upstanding ribs is positioned on each of the tops of the support whereby a corner of a tile can be disposed between the ribs of adjacent supports to progressively build the floor.

DESCRIPTION OF THE PREFERRED EMBODIMENTS

Figure 1:
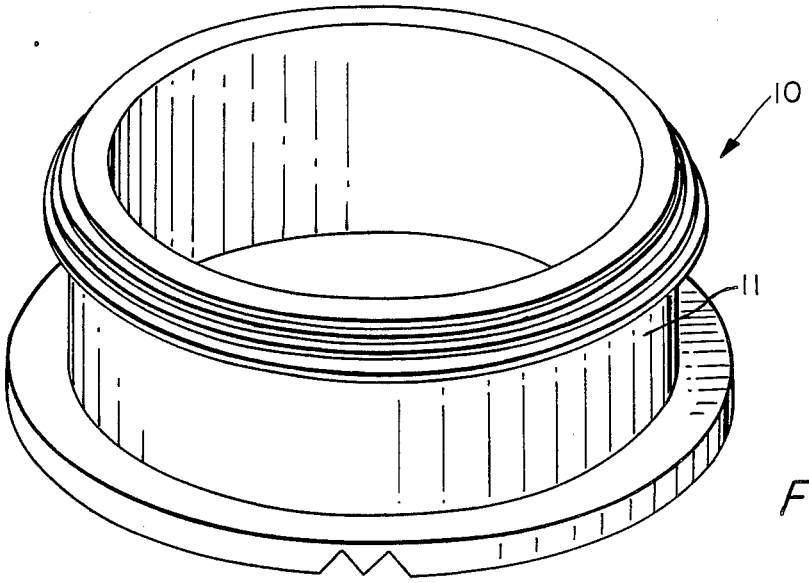
FIG. 1 is a perspective view of the support of the present invention on a collapsed position.
Figure 2:
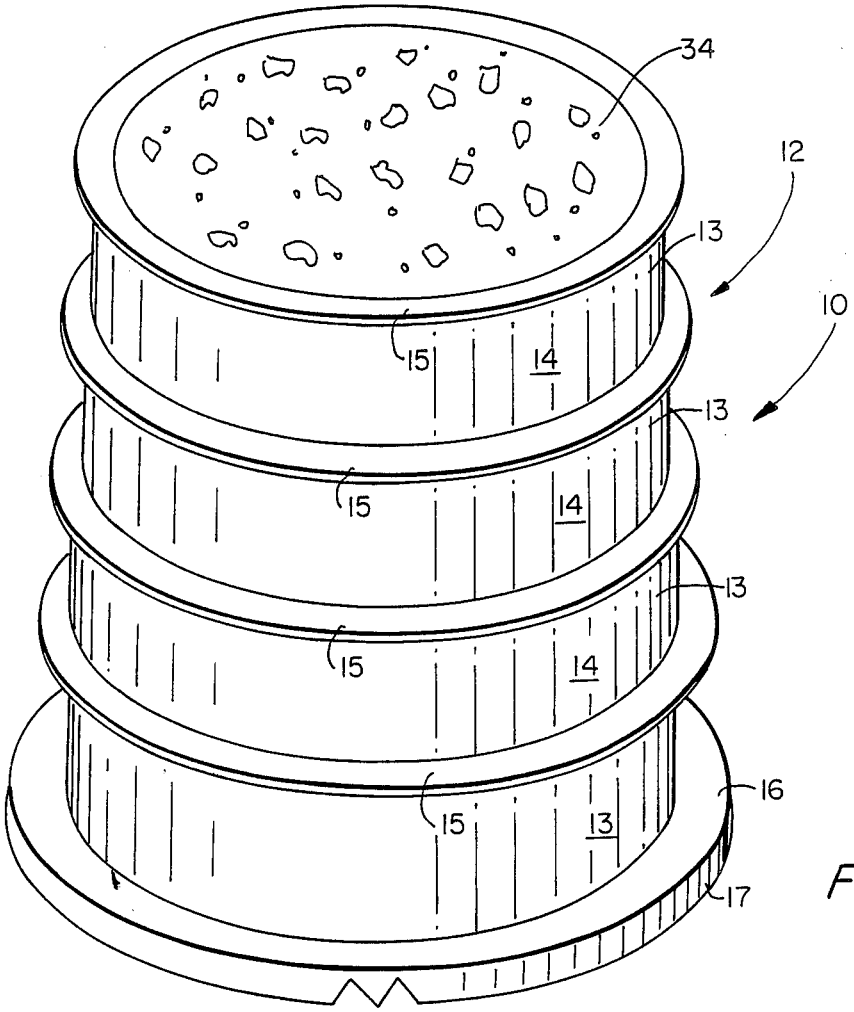
FIG. 2 is a perspective view of the support in an extended position.
Figure 3:
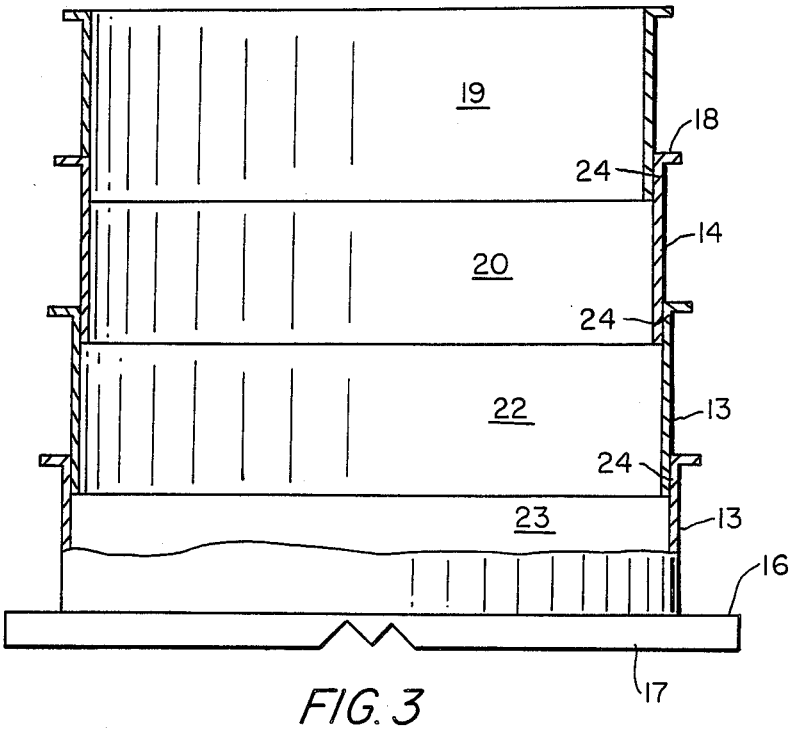
FIG. 3 is a cross-sectional view of the support of FIG. 2 showing details of the same.
Figure 4:
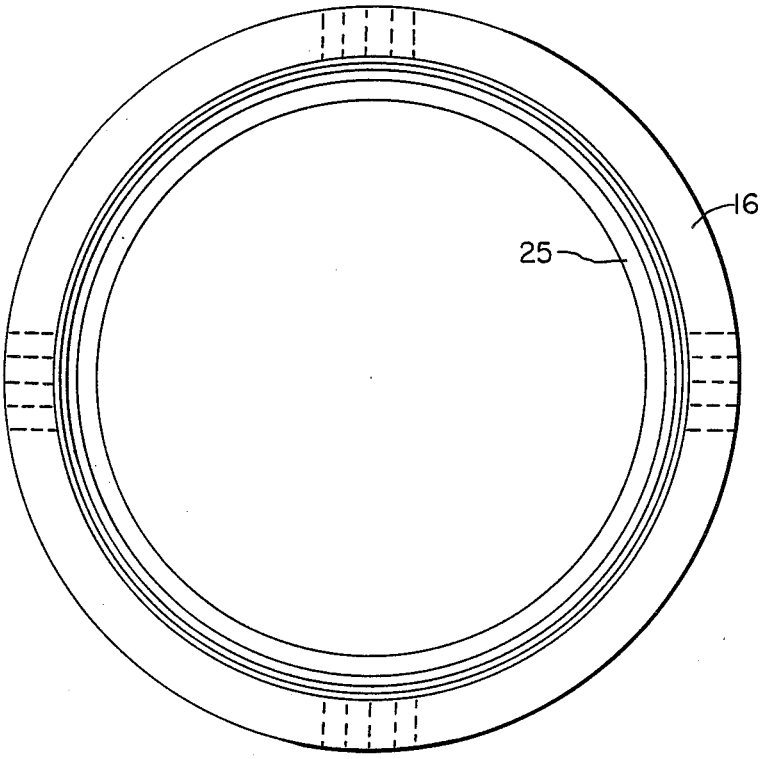
FIG. 4 is a top view of FIG. 3 including details of the locking means associated with the support.

With reference to FIGS. 1 and 2 of the drawing, the adjustable pedestal of the present invention is depicted generally by the numeral 10 and is shown in its collapsed, 11, and extended, 12, positions, respectively. As seen in FIG. 2, the pedestal 10 is comprised of a plurality of annular members 13 nested one within the other with each being formed with an upstanding tapered wall 14, see FIG. 3, having an outwardly extending flange 15 being provided on the top edge thereof. The flange 15 serve both to insure that the annular members 13 do not slide totally within each other in the collapsed position, 11, and to permit the same to be readily grasped and manipulated to the desired extended position, 12. The lower member 13 thereof has its bottom edge closed and is provided with an outwardly extending base 16 and is of a thickness 17 to support the pedestal. Each of the members 13 is seen to be "L" shaped in cross-section at 18 in FIG. 3 with each having successively increasing diameters 19, 20, 21, 22, 23 from top to bottom with approximately $\frac{1}{4}$ of the lower portion of each member 13 overlapping the upper portion of its next adjacent member as at 24 in its extended position to rigidify the pedestal when normally extended with the flanges 15 being generally parallel to each other. The locking of one member 11 to the other in the extended position is accomplished by forming each of the members 13 with a cam area 25, FIG. 4, over a section of the wall 14 which is out of round with respect to the diameter of each member 13 so that when the members are extended the cam areas frictionally engage a non-cam surface of the adjacent member 13 to frictionally lock one to the other in the extended position.

Figure 5:
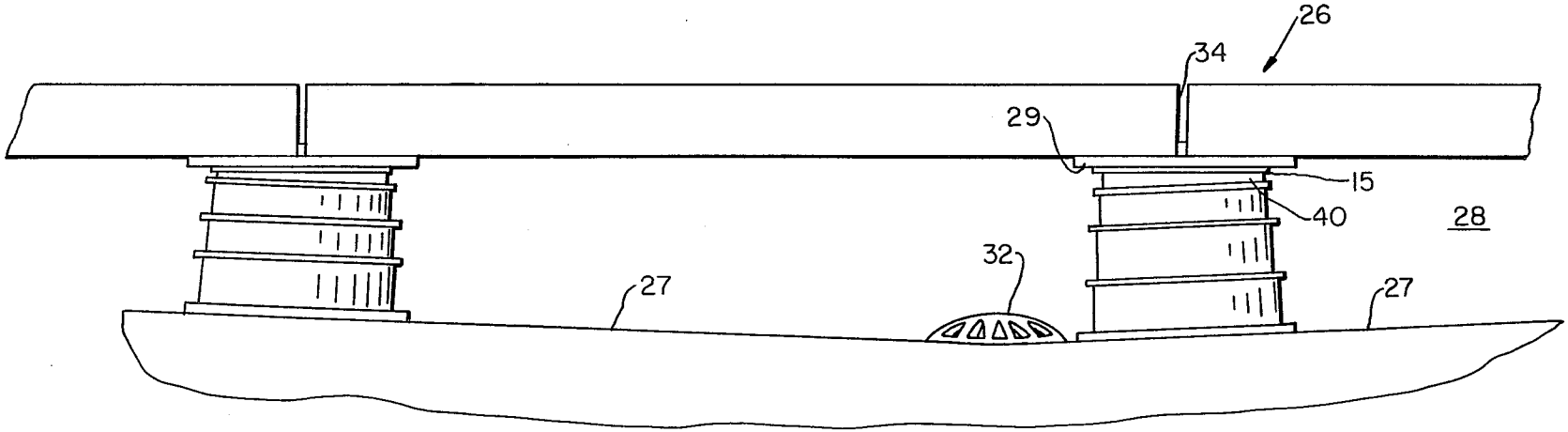
FIG. 5 is an elevation view of a plurality of supports and a floor associated therewith.
Figure 6:
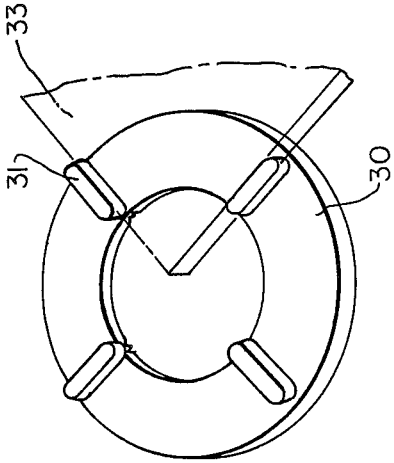
FIG. 6 is a top view of a ring member used in assembling the floor onto the support.

The structural association of the members 11 is such that the members can be angularly positioned with respect to one another to compensate for uneven surfaces on which the pedestals are placed. This versatility is best illustrated in the showing of FIG. 5 wherein it is desirous to construct a flat even surface 26 such as a terrace, patio, concourse or the like over an inclined roof 27 thereby utilizing space which heretofore would be unusable. As seen each of the pedestals 10 is adjustably positioned both in a vertical and angular manner as at 40, to position the topmost flanges 15 of each unit in an even parallel plane 28. A ring member 29 is thereafter placed on the topmost member 13 and supported thereon by the flanges 15. These rings 29 are comprised of a flat surface 30 having upstanding ribs 31 spaced every 90 degrees therearound forming four quadrants which permit the placing of a corner 32 of rectangular building blocks or tiles 33 between adjacent ribs as seen in FIG. 6. The ribs 31 space the edges of the blocks or tiles 33 from one another as at 34 to permit water to pass therethrough into roof drains 32.

The adjustable pedestals can be fabricated from metal or plastic and be of any given dimensions as desired and in some instances, depending on the environment in which they are to be used, the interior can be filled with concrete 34, FIG. 2, after the height and angulation, if any, has been set to further structurally strengthen the same.

While a preferred embodiment of the invention has been described using specific terms, such description is for illustrative purposes only, and it is to be understood that changes and variations may be made without departing from the spirit or scope of the following claims.

I claim:

1. A pedestal comprising a plurality of similar substantially annular members telescoping one within the other and each having a wall tapering from the bottom to the top, with the walls being in contact with the next adjacent wall, and locking means associated with each wall for locking one wall to the other in an extended position, said locking means being formed in a portion of the wall by distorting the roundness of the same;

wherein the lowermost member is provided with a base for supporting the remaining annular members;

wherein each member has a flange extending outwardly from the top thereof to prevent one member from totally sliding within its next adjacent member while providing a finger grasping surface to facilitate the extending and the angular disposition of each of the same; and placing concrete in said annular member and wherein a support member positioned on the topmost annular member is provided with upstanding equidistantly spaced ribs whereby a corner of a tile can be disposed between adjacent ribs.

2. The pedestal of claim 1 wherein a plurality of pedestals are used in conjunction with an uneven support surface to dispose the support members in a common plane thereby placing said tiles in an even plane.

3. The method of converting unusable space to usable space comprising the steps of placing a plurality of adjustable pedestals selectively thereover, said pedestals having a plurality of similar substantially annular members telescoping one within the other and each having a wall tapering from the bottom to the top, with the walls being in contact with the next adjacent wall, and locking means associated with each wall for locking one wall to the other in an extended position, said locking means being formed in a portion of the wall by distorting the roundness of the same, extending and angularly positioning said annular members whereby the topmost member of each is positioned and locked in a common plane, with respect to each other and placing a tile between adjacent supports to form an even usable surface.

4. The method of claim 3 further including the step of placing a support member on each of the topmost members to facilitate the placing and locating of tile thereon in said common plane.

5. The method of claim 4 further including the step of depositing anchoring material within the interior of the annular members.

* * * * *